US007614622B2

(12) United States Patent
Muramatsu

(10) Patent No.: US 7,614,622 B2
(45) Date of Patent: Nov. 10, 2009

(54) SHEET FEEDING APPARATUS AND IMAGE FORMING APPARATUS

(75) Inventor: Motoyasu Muramatsu, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 11/186,904

(22) Filed: Jul. 22, 2005

(65) Prior Publication Data

US 2006/0022396 A1 Feb. 2, 2006

(30) Foreign Application Priority Data

Jul. 27, 2004 (JP) ..... 2004-218742

(51) Int. Cl.
*B65H 3/06* (2006.01)
*B65H 3/52* (2006.01)

(52) U.S. Cl. ..... 271/119; 271/121; 271/124; 271/109

(58) Field of Classification Search ..... 271/119, 271/121, 113, 109
See application file for complete search history.

(56) References Cited

U.S. PATENT DOCUMENTS

| | | | | |
|---|---|---|---|---|
| 5,132,736 | A | 7/1992 | Muramatsu et al. | 355/271 |
| 5,372,359 | A * | 12/1994 | Miura et al. | 271/119 |
| 5,374,047 | A * | 12/1994 | Tsukamoto et al. | 271/10.01 |
| 5,420,664 | A * | 5/1995 | Miwa et al. | 399/167 |
| 5,749,040 | A | 5/1998 | Muramatsu | 399/406 |
| 5,933,698 | A | 8/1999 | Muramatsu | 399/406 |
| 6,126,161 | A * | 10/2000 | Kato | 271/121 |
| 6,145,831 | A * | 11/2000 | Inoue et al. | 271/121 |
| 6,173,951 | B1 * | 1/2001 | Inoue et al. | 271/121 |
| 6,585,253 | B1 * | 7/2003 | Miki | 271/125 |
| 6,662,139 | B2 * | 12/2003 | Inoue et al. | 702/173 |
| 7,128,316 | B2 * | 10/2006 | Nakano et al. | 271/121 |
| 7,184,692 | B2 * | 2/2007 | Kwon | 399/167 |
| 2006/0022396 | A1 | 2/2006 | Muramatsu | 271/121 |

FOREIGN PATENT DOCUMENTS

| | | | |
|---|---|---|---|
| JP | 01156239 A | * | 6/1989 |
| JP | 8-91608 | | 4/1996 |

* cited by examiner

*Primary Examiner*—Patrick H Mackey
*Assistant Examiner*—Luis Gonzalez
(74) *Attorney, Agent, or Firm*—Fitzpatrick, Cella, Harper & Scinto

(57) ABSTRACT

An apparatus is provided with a feed roller that is rotatable to apply a feeding force on a sheet, a separating pad for pressing the sheet against the feed roller and a roller portion provided coaxially with a support shaft of the feed roller to position the feed roller relative to the separating pad. A damping member for suppressing vibration of the sheet is provided on a side surface of the roller portion to prevent an unusual noise from being generated.

7 Claims, 8 Drawing Sheets

SHEET FEEDING APPARATUS AND IMAGE FORMING APPARATUS

BACKGROUND OF THE INVENTION

1. Field of the Invention

The present invention relates to a sheet feeding apparatus for feeding a copying machine, a facsimile machine, a printer or the like with originals or recording sheets and relates to an image forming apparatus using the same.

2. Description of Related Art

In recent years, in the field of sheet feeding apparatuses equipped in image forming apparatuses such as copying machines and printers, reduction of operation noise as well as stabilization of sheet feeding performance has been a challenge that has been receiving attention.

The sheet feeding apparatus used in a copying machine, a printer or the like is adapted to separate and send out stacked sheets one after another. In a conventional method adopted in the sheet feeding apparatus, sheets are separated one by one by means of a feed roller for feeding a sheet and a separating pad that is biased against the feed roller to prevent double feeding. In this sheet separating method, stick-slip (minor vibration) may occur between the sheet and the separating pad depending on the type of the sheet fed, and this vibration sometimes causes an unusual noise (uncomfortable noise). To prevent such an unusual noise from occurring, in a method that has been proposed, for example in Japanese Patent Application Laid-Open No. H8-091608, a damping member is provided on the separating pad to suppress vibration of the separating pad, thereby preventing generation of an unusual noise.

However, although vibration of the separating pad can be effectively reduced by the above-described conventional method, it is not possible to sufficiently reduce vibration of the sheet itself, which is the source origin of the vibration.

Accordingly, there is a possibility that the vibration suppression effect cannot be achieved depending on the structure of the sheet feeding apparatus and that the vibration may be magnified to make the unusual noise lauder.

To suppress vibration of the sheet, contact pressure of the feed roller and the separating pad may be adjusted. However, when the contact pressure is made small, sufficient sheet feeding performance cannot be achieved, and sheet feed failure may occur. In contrast, when the contact pressure is made large, the possibility of occurrence of stick-slip between the sheet and the separating pad increases to make the possibility of generating an unusual noise higher.

SUMMARY OF THE INVENTION

The present invention has been made in view of the above-described problems, and has as an object to provide a sheet feeding apparatus in which generation of an unusual noise during sheet feeding can be suppressed without deteriorating sheet feeding performance and to provide an image forming apparatus equipped with the same.

To achieve the above object, an apparatus according to the present invention comprises a feed roller having a cut-away portion on its outer circumference, the outer circumference of the feed roller being to be in frictional contact with a top surface of a sheet stack to apply a feeding force on a sheet, a pad member that is in pressure contact with said feed roller for separating sheets between itself and the feed roller, and a roller portion having a shape smaller than the outer diameter of said feed roller and protruding outwardly beyond said cut-away portion, said roller portion coming in contact with said pad member when said cut-away portion of the feed roller is opposed to said pad member, wherein a vibration suppression member provided on a side surface of said roller portion for suppressing vibration that may occur during sheet feeding.

Another apparatus according to the present invention comprises a feed roller having a cut-away portion on its outer circumference, the outer circumference of the feed roller being to be in frictional contact with a top surface of a sheet stack to apply a feeding force on a sheet, a pad member that is in pressure contact with said feed roller for separating sheets between itself and the feed roller, and a roller portion having a shape smaller than the outer diameter of said feed roller and protruding outwardly beyond said cut-away portion, said roller portion coming in contact with said pad member when said cut-away portion of the feed roller is opposed to said pad member, wherein a pressure contact member provided in pressure contact with the outer circumferential surface of said roller portion for suppressing vibration that may occur during sheet feeding.

Another apparatus according to the present invention comprises a feed roller having a cut-away portion on its outer circumference, the outer circumference of the feed roller being to be in frictional contact with a top surface of a sheet stack to apply a feeding force on a sheet, a pad member that is in pressure contact with said feed roller for separating sheets between itself and the feed roller, and a roller portion having a shape smaller than the outer diameter of said feed roller and protruding outwardly beyond said cut-away portion, said roller portion coming in contact with said pad member when said cut-away portion of the feed roller is opposed to said pad member, wherein the total weight of said roller portion is set to such a weight with which vibration that may occur during sheet feeding is suppressed.

DESCRIPTION OF THE PREFERRED EMBODIMENTS

In the following, a sheet feeding apparatus according to an embodiment of the present invention will be described together with an image forming apparatus equipped with the same with reference to the drawings.

First Embodiment

A sheet feeding apparatus according to the first embodiment and an image forming apparatus equipped with the same will be described with reference to FIGS. 1 to 6.

(Overall Structure of the Image Forming Apparatus)

Firstly, the overall structure of the image forming apparatus equipped with the sheet feeding apparatus will be briefly described with reference to FIG. 6.

Figure 6:
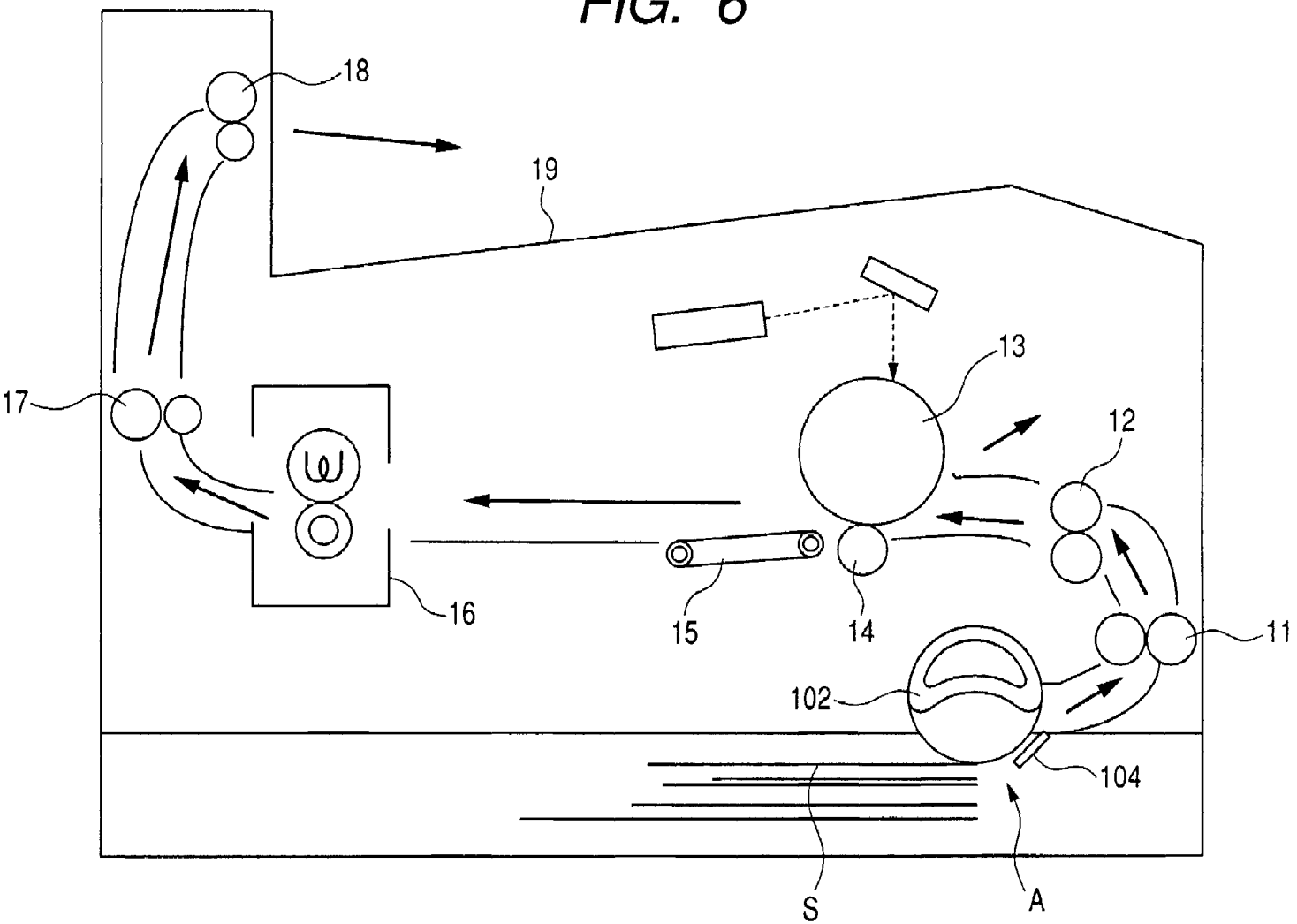
FIG. 6 is a schematic cross sectional view of an image forming apparatus.

As shown in FIG. 6, a sheet feeding apparatus A is provided in the lower portion of the main body of the image forming apparatus. The structure of the sheet feeding apparatus A will be described in detail later. A sheet S fed from the sheet feeding apparatus A is conveyed to an image forming portion by means of a conveying roller pair 11 and a registration roller pair 12. The image forming portion in this embodiment is adapted to form an image using an electrophotography process and provided with an electrophotographic photosensitive drum 13 and charging means (not shown) and developing means (not shown) that are disposed in the vicinity of the photosensitive drum 13. A toner image is formed on the photosensitive drum 13 in synchronization with sheet conveyance, and the toner image is transferred onto a sheet S conveyed with the aid of a transfer bias applied on a transfer roller 14.

The sheet S on which the toner image has been transferred is conveyed to a fixing device 16 by a conveying belt 15, subjected to heat fixing, and then discharged by discharge roller pairs 17, 18 onto a discharge portion 19 on the top of the apparatus main body.

(Sheet Feeding Apparatus)

Figure 1:
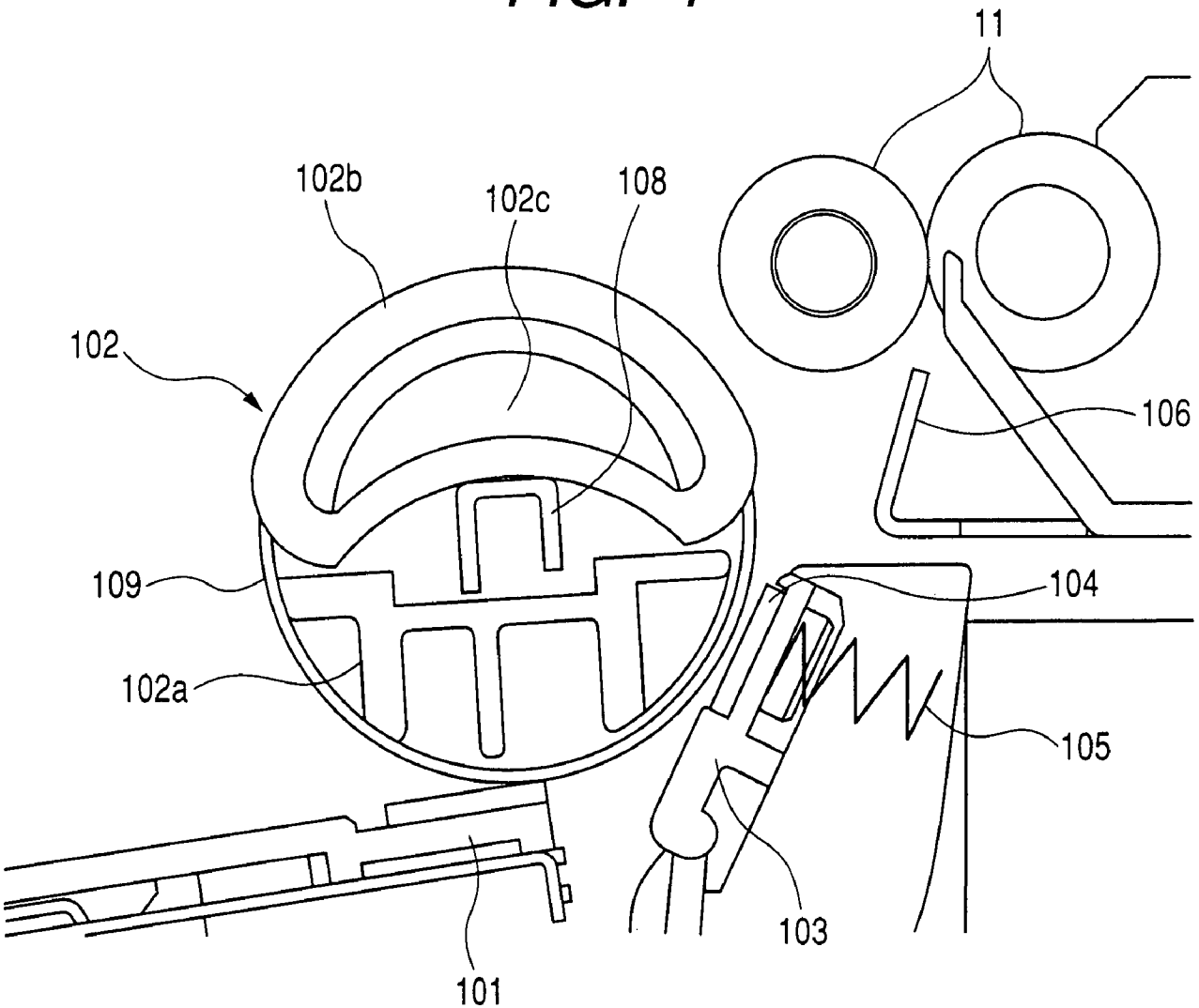
FIG. 1 is a cross sectional view illustrating the structure of a sheet feeding apparatus according to a first embodiment.
Figure 2:
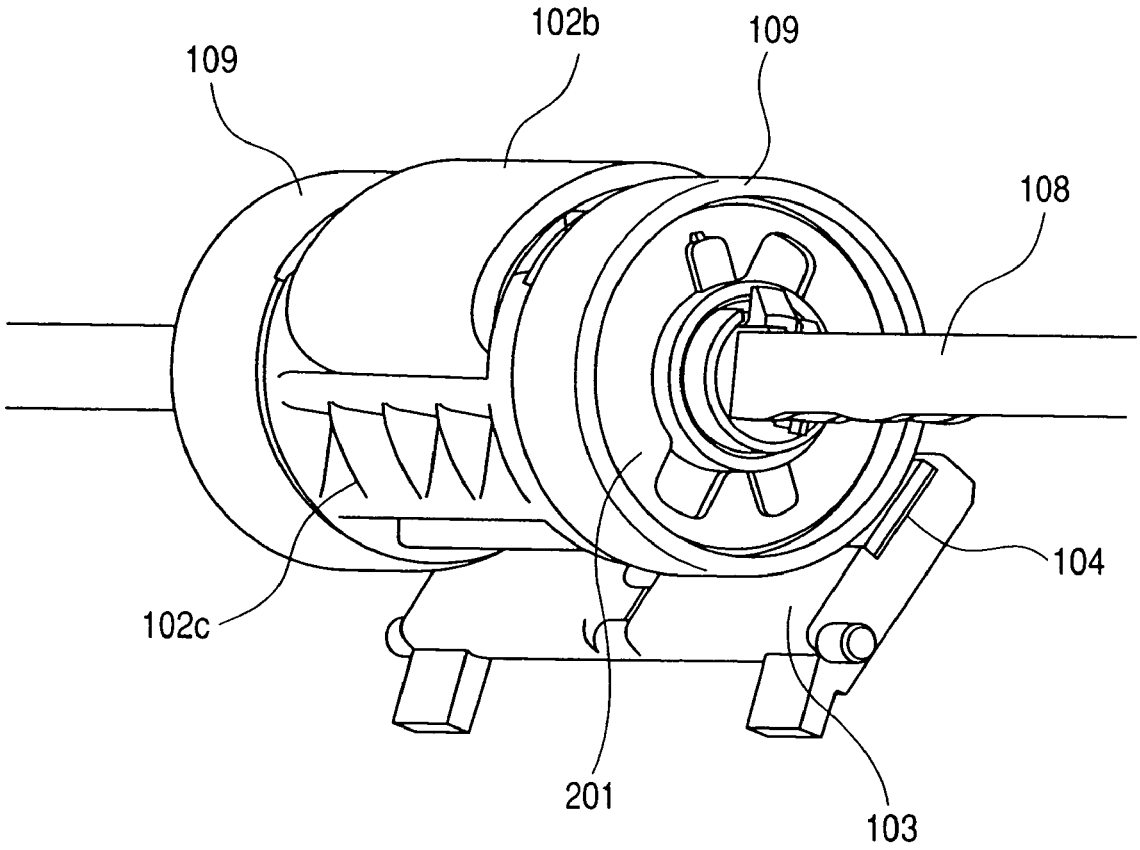
FIG. 2 is a perspective view illustrating the structure of the sheet feeding apparatus according to the first embodiment.

Next, the sheet feeding apparatus A will be described. FIGS. 1 and 2 schematically illustrate an example of the sheet feeding apparatus according to the first embodiment.

Reference numeral 101 designates an inner plate provided in a sheet feed cassette (not shown) for pressing up sheets stacked on its top face. Reference numeral 102 designates a feed roller with which the tip end portion of the top sheet in the stack of sheets pressed up by the inner plate 101. The feed roller 102 includes a core 102*a*, a roller portion 102*b* attached to the core 102*a* and a roller holder 102*c* fixed on a rotary shaft 108. The core 102*a* on which the roller portion 102*b* is attached is secured on the roller holder 102*c*.

On both sides of the feed roller 102, roller portions 109 are disposed. The roller portions 109 are adapted to be rotatable relative to the rotary shaft 108 or the roller holder 102*c*.

In FIGS. 1 and 2, reference numeral 103 designates a separating pad holding member provided below the feed roller 102. Reference numeral 104 designates a separating pad serving as a pad member that is provided on the upper portion of the separating pad holding member 103 and is in contact with the lower side of the feed roller 102. Reference numeral 105 designates a spring that biases the separating pad holding member 103 toward the feed roller 102. The separating pad holding member 103 is capable of swinging within a predetermined range with a hinge member that is not shown in the drawings.

When the feed roller 102 rotates, the roller portion 102*b* of the feed roller 102 is in contact with the top sheet of the stacked sheets to send it out. If a plurality of sheets are sent out, they are separated one by one while they pass between the separating pad 104 and the feed roller 102. The sheets thus separated is conveyed to the image forming portion by the conveying roller pair 11 while being guided by a conveying guide 106.

Let Ra, Rb and Rc be the radii of the outer circumference of the roller holder 102*c*, the roller portion 109 and the roller portion 109 and the roller portion 102*b* respectively. The radius Rb of the outer circumference of the roller portion 109 is larger than the radius Ra of the outer circumference of the roller holder 102*c*, and the radius Rc of the outer circumference of the roller portion 102*b* attached on the core 102*a* is larger than the radius Rb of the outer circumference of the aforementioned roller portion 109 (i.e. Ra<Rb<Rc). Consequently, when the roller portion 109 is attached to the rotary shaft 108 or the roller holder 102*c*, the outer circumference of the roller portion 109 is located inside the outer circumference of the roller portion 102*b* and outside the outer circumference of the roller portion 102*c*. With the above structure, the feed roller 102 constitutes a structure having a cut-away potion on its outer circumference (i.e. a so-called semicircular roller).

Figure 3:
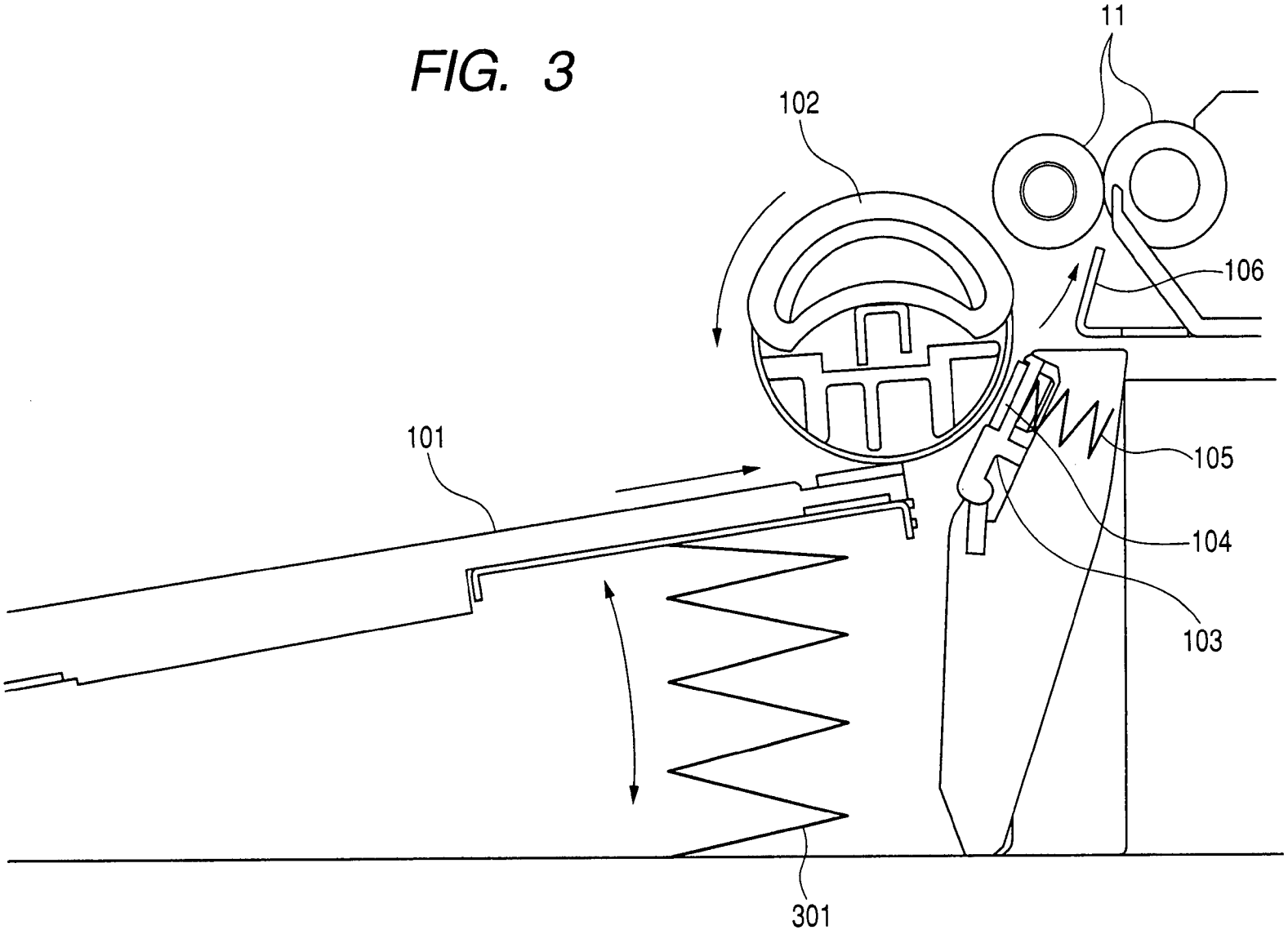
FIG. 3 illustrates the sheet feeding apparatus according to the first embodiment in its standby state before separating and conveying a sheet.

FIG. 3 illustrates the sheet feeding apparatus according to this embodiment in a standby state before separately conveying a sheet. As the inner plate 101 is pressed up by the biasing spring 301, the sheet stack on the inner plate 101 is in contact with the two roller portions 109. In addition, the separating pad 104 is biased by the spring 105 in such a way as to be in contact with the two roller portions. Accordingly, the positions of the feed roller 102 and the separating pad 104 in the stand-by state are determined by the roller portions 109.

When the feed roller 102 rotates, the outer circumference of the feed roller 102 comes in contact with the top sheet to apply a conveying force. Thus, the top sheet is sent out. The sheet thus sent out passes through the nip portion between the roller portion 109 and the separating pad 104 and is conveyed by the conveying roller pair 11. The feed roller 102 is caused to make one revolution by a clutch mechanism (not shown), and stopped in a position in which the cut-away outer circumference portion of the feed roller 102 is opposed to the separating pad 104.

Since the conveying roller pair 11 is continuously rotating during this process, the sheet passing between the roller portion 109 and the separating pad 104 is further conveyed by the conveying roller pair 11 continuously. Since the roller portions 109 are rotatably mounted on the rotary shaft 108 or the roller holder 102*c*, they rotate following movement of the conveyed sheet. Thus, the roller portions 109 rotate and the sheet is conveyed while being in contact with the separating pad 104, which prevents double feeding of sheets with a small back tension against the conveying force.

(Vibration Suppression Means for the Roller Portions)

The sheet feeding apparatus A according to this embodiment is provided with vibration suppression means for suppressing vibration of the roller portions 109 during conveying a sheet. The structure of the vibration suppression means will be described in the following.

Figure 4A:
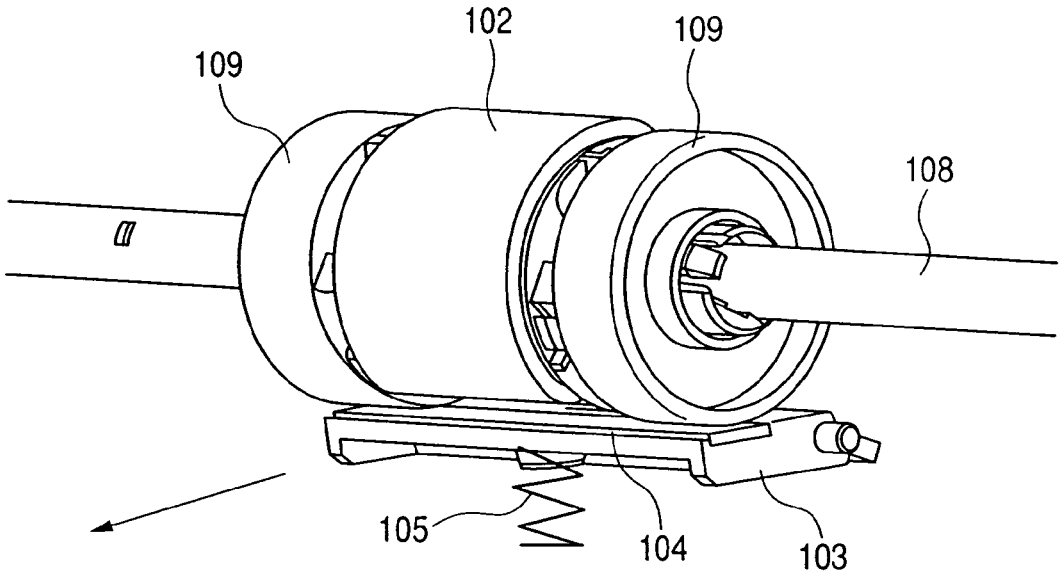
FIGS. 4A and 4B are enlarged views of a sheet feeding portion during conveying a sheet, FIG. 4A illustrating a case in which a damping member is not provided and FIG. 4B illustrating a case in which a damping member is provided.
Figure 4B:
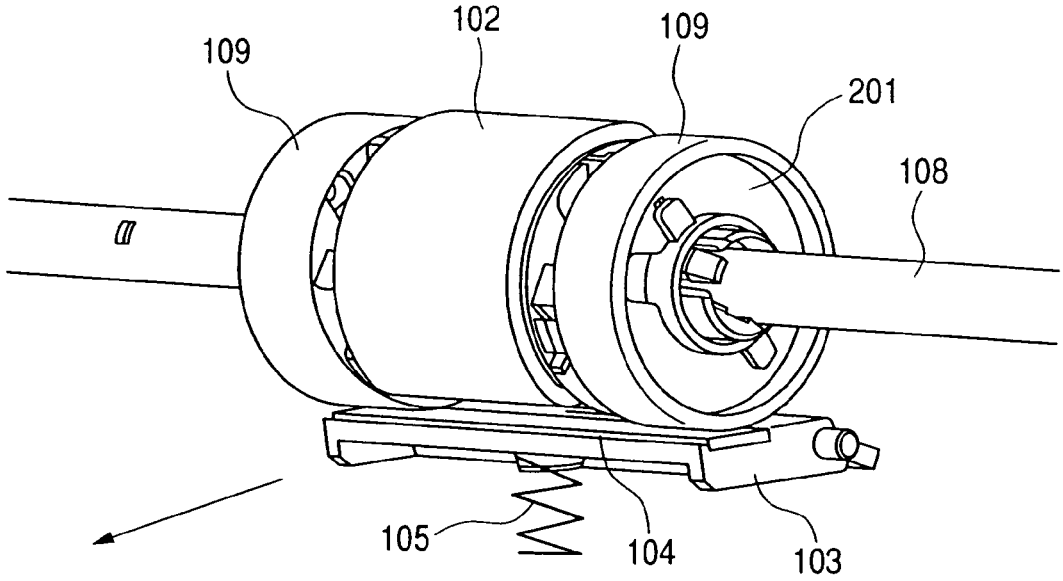

FIGS. 4A and 4B are enlarged views illustrating the sheet feeding portion during conveying a sheet. In the sheet feeding apparatus A described above, the sheet sent out by the feed roller 102 is conveyed while being nipped by the separating pad 104 and the roller portions 109. The nipping force is determined by the elastic force of the spring 105 that biases the separating pad holding member (in this embodiment, the elastic force being 200 (gf)).

While a sheet is conveyed by the conveying roller pair 11, stick-slip can sometimes occur due to friction between the sheet and the separating pad 104, depending on the type of the sheet. Such stick-slip is a cause of an unusual noise called "pad noise".

Occurrence of stick-slip in the sheet feeding portion depends on the elastic force of the spring that presses the separating pad 104, the sheet conveying speed, the type of the sheet, the stiffness of the sheet, the friction coefficient of the separating pad 104, the rigidities of various parts of the feeding portion etc. These factors are closely linked with the feeding performance of the sheet feeding apparatus, and it is difficult to satisfy both requirements for the sheet feeding performance and requirements for countermeasure against the unusual noise.

Under such circumstances, in this embodiment, as a countermeasure against unusual noises, vibrations of the roller portions 109 are reduced without deteriorating the sheet conveying performance to prevent generation of an unusual noise.

When vibration suppression means is not provided on the roller portion 109 as shown in FIG. 4A, due to vibration transmitted from the sheet, the roller portions 109 also vibrate. Therefore, it is difficult to suppress vibration of the sheet caused by stick-slip.

In view of this, in this embodiment, damping members 201, such as rubber members or resin members, having a damping property are provided on the side surfaces of the roller portions 109 without contact with the separating pad 104, as shown in FIG. 4B. In this embodiment, the roller portion 109 is made of a polyacetal resin (POM) material and the damping member 201 is made of a rubber vibration isolator sheet. The material of the damping member 201 is selected in such a way as to sufficiently meet the requirement of suppressing vibration under an elastic force of the spring 105 that biases the separating pad of 200 gf and a conveying speed of 50 mm/s.

As per the above, vibration of the sheet is suppressed by providing the damping members 201 on the side surfaces of the roller portions 109. Furthermore, vibration of the roller portions caused by vibration transmitted from the sheet is also suppressed. Accordingly, continuous vibration like stick-slip is prevented from occurring during conveying the sheet, and it is possible to suppress generation of an unusual noise.

Figure 5A:
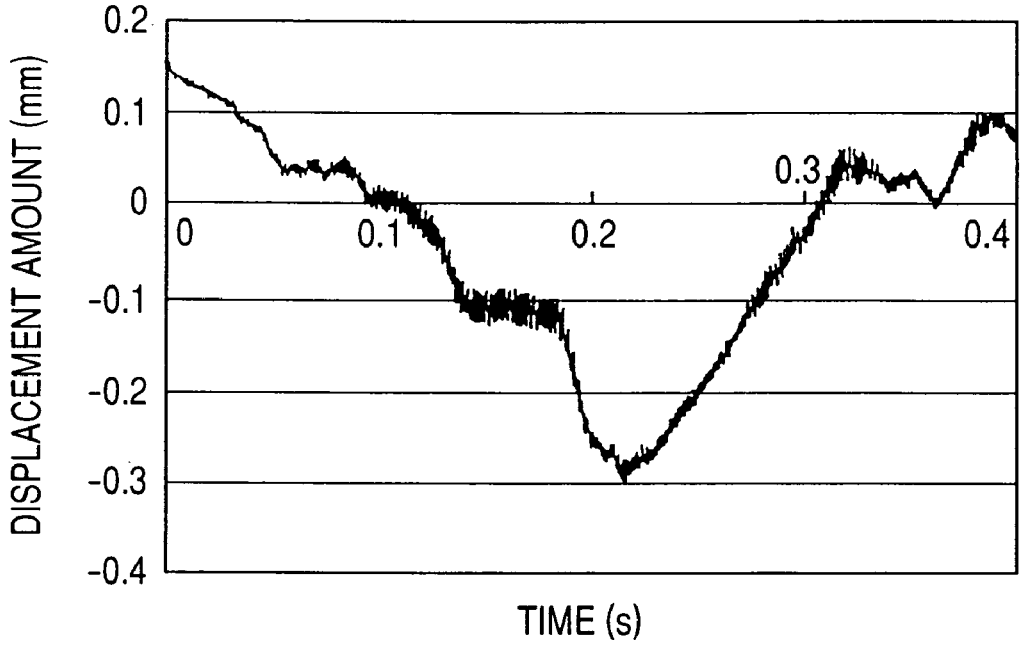
FIGS. 5A and 5B are graphs showing results of measurement of displacement of a sheet with time in a roller portion while the sheet is conveyed, FIG. 5A illustrating a case in which a damping member is not provided and FIG. 5B illustrating a case in which a damping member is provided.
Figure 5B:
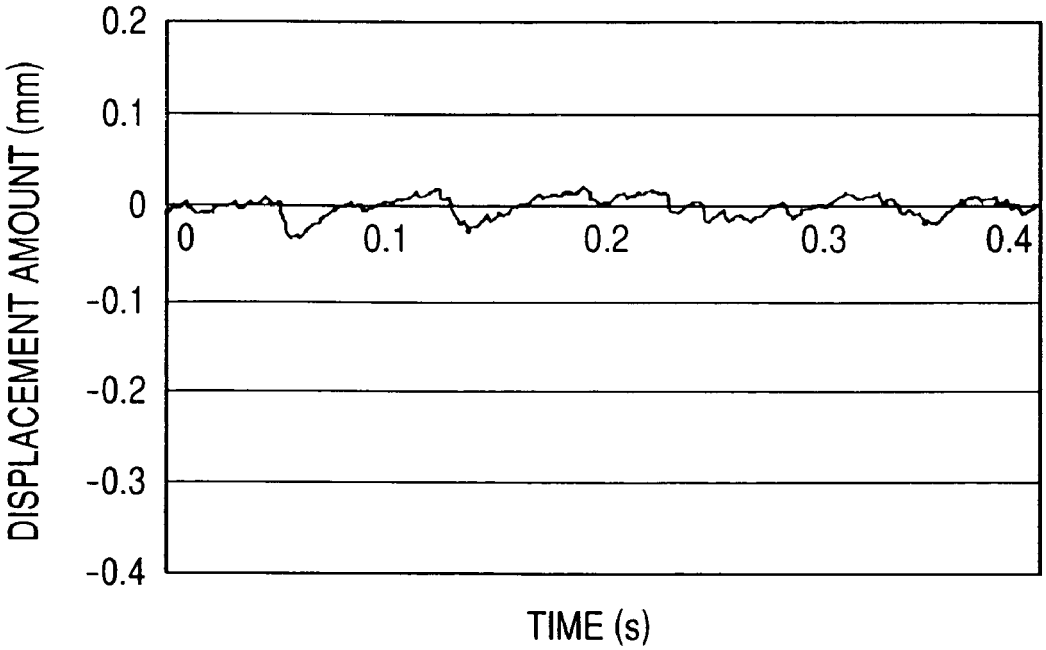

FIG. 5A is a graph showing a measurement result of changes in the displacement amount of a sheet with time on the separating pad 104 and between the two roller portions 109 when an unusual noise is generated while the sheet is conveyed in a conventional sheet feeding apparatus in which vibration suppression means is not provided on the roller portions 109. On the other hand, FIG. 5B is a graph showing a measurement result of changes in the displacement amount of a sheet with time while the sheet is conveyed in the sheet feeding apparatus of this embodiment in which the damping members 201 are attached on the roller portions 109.

It will be seen from FIG. 5A that when an unusual noise is generated, small vibrations are occurring due to stick-slip. On the other hand, it will be seen from FIG. 5B that vibration of the sheet can be suppressed by attaching the damping members 201 on the roller portions 109.

As per the above, by adhering the damping members 201 on the side surfaces of the roller portions 109 or providing the damping members 201 attached to the roller portions 109 with the roller portion 109 between, it is possible to damp vibration occurring in the sheet to prevent an unusual noise from occurring.

Alternatively, weights may be attached to the roller portions 109 or the diameter, the weight or the relative density of the roller portions 109 may be increased to suppress vibration of the roller portions 109, and in addition, the resonance point may be increased to make the roller portions 109 hard to vibrate.

Second Embodiment

Next, a sheet feeding apparatus according to the second embodiment will be described with reference to FIGS. 7A and 7B. The basic structure of the apparatus according to this embodiment is the same as that of the above-described first embodiment, and redundant descriptions thereof will be omitted. Here, features that characterize this embodiment will be described. Members having the functions same as those in the above-described first embodiment will be designated by the same reference signs.

This embodiment differs from the above-described first embodiment in that the damping members 201 are not provided on the roller portions, but pressure contact members for externally biasing the roller portions 109 are provided.

Figure 7A:
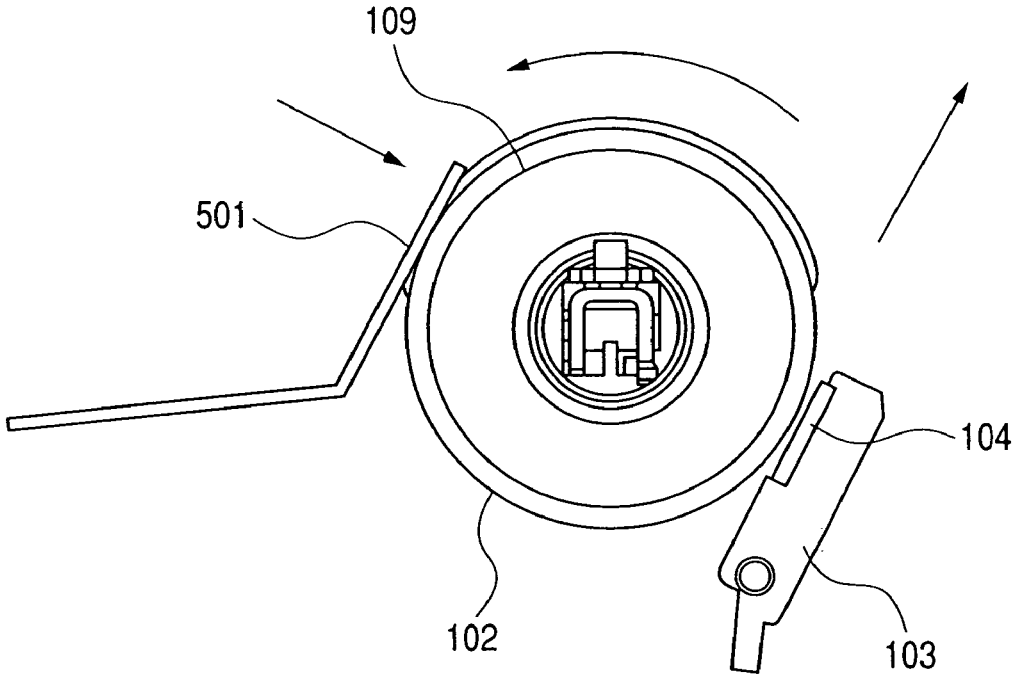
FIGS. 7A and 7B schematically illustrate a sheet feeding apparatus according to a second embodiment and examples of a pressure contact member.
Figure 7B:
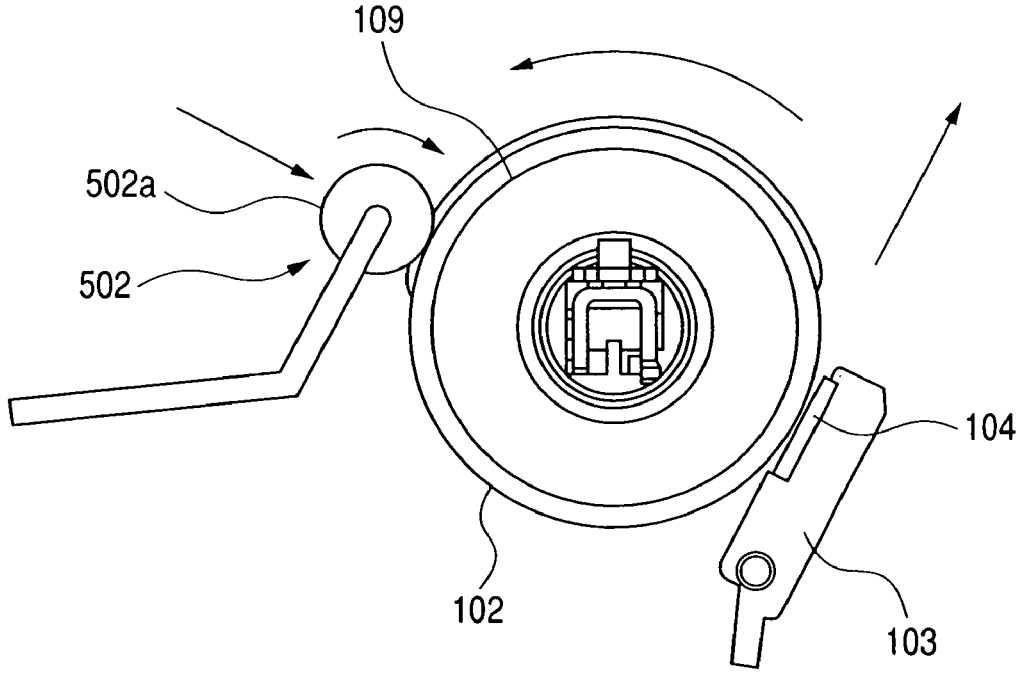

FIGS. 7A and 7B schematically show the structure of examples of the pressure contact member in the sheet feeding apparatus according to the second embodiment. FIG. 7A shows a pressure contact member 501 having elasticity opposed to the roller portion 109. One end of the pressure contact member 501 is fixedly attached on the apparatus main body, and the other end is in pressure contact with the outer circumferential surface of the roller portion 109. FIG. 7B shows an pressure contact member 502 having elasticity opposed to the roller portion 109. One end of the pressure contact member 502 is fixedly attached on the apparatus main body, and the pressure contact member 502 has a rotatable roller 502*a* at the other end that is in pressure contact with the outer circumferential surface of the roller portion 109.

The pressure contact members 501, 502 press the two roller portions with substantially equal pressing forces. By pressing the outer circumferential surfaces of the roller portions 109 with the pressure contact members 501, 502, it is possible to prevent the roller portions 109 from vibrating due to vibration transmitted from the sheet and to prevent continuous vibration like stick-slip from occurring to suppress generation of an unusual noise.

In connection with this, it is desirable that the pressing force of the pressure contact members 501, 502 against the roller portions 109 be sufficient for applying the load required to prevent transmission of vibration from the sheet. In this embodiment, the pressing force for each roller portion 109 is set to 10 gf.

In the case of the structure in which the pressure contact member is in contact with the roller portion 109 as is the case with the pressure contact member 501 shown in FIG. 7A, there is a possibility that the resistance between the pressure contact member 501 and the roller portion 109 will act as rotational load on the roller portion while the sheet is conveyed to generate a back tension. In view of this, in cases where the sheet feeding apparatus is used in a color image forming apparatus that uses color toners or inks of yellow, magenta, cyan and black, it is preferred to provide a rotatable roller 502*a* at the end of the pressure contact member 502 as shown in FIG. 7B so that the roller portion 109 is biased by means of the roller 502*a*.

In this embodiment, a rubber or plastic member having a damping property is used as the material of the roller 502*a* of the pressure contact member 502 to enhance vibration suppression performance of the roller portion 109 while reducing resistance against rotation of the roller portion 109.

Third Embodiment

Next, an apparatus according to the third embodiment will be described with reference to FIGS. 8 and 9. The basic structure of the apparatus according to this embodiment is the same as that of the above-described first embodiment, and redundant descriptions thereof will be omitted. Here, features that characterize this embodiment will be described. Members having the functions same as those in the above-described first embodiment will be designated by the same reference signs.

This invention differs from the above-described embodiment in that the total weight of the roller portions 109 is determined in such a way as to suppress vibration of the sheet.

In this embodiment, damping members 201 in the form of metal pieces are attached to adjust the total weight of the roller portions 109. The roller portion 109 is made of a POM material, and a metal piece 201 having a thickness of 1 mm is attached thereto. Thus, the total weight of each roller portion 109 and damping member (metal piece) 201 is set to 5 grams.

The material of the damping member (metal piece) 201 is selected in such a way as to sufficiently meet the requirement of suppressing vibration under an elastic force of the spring 105 that biases the separating pad 104 of 200 gf and a conveying speed of 50 mm/s. The damping member (metal piece) 102 may be made heavier, in other word, the thickness of the metal piece may be made thicker to enhance the damping effect. However, that will lead to an increase in the cost. In this embodiment, metal pieces with a thickness of 1 mm are used so that a plurality of metal pieces can be attached in accordance with the weight to be set.

Figure 8:
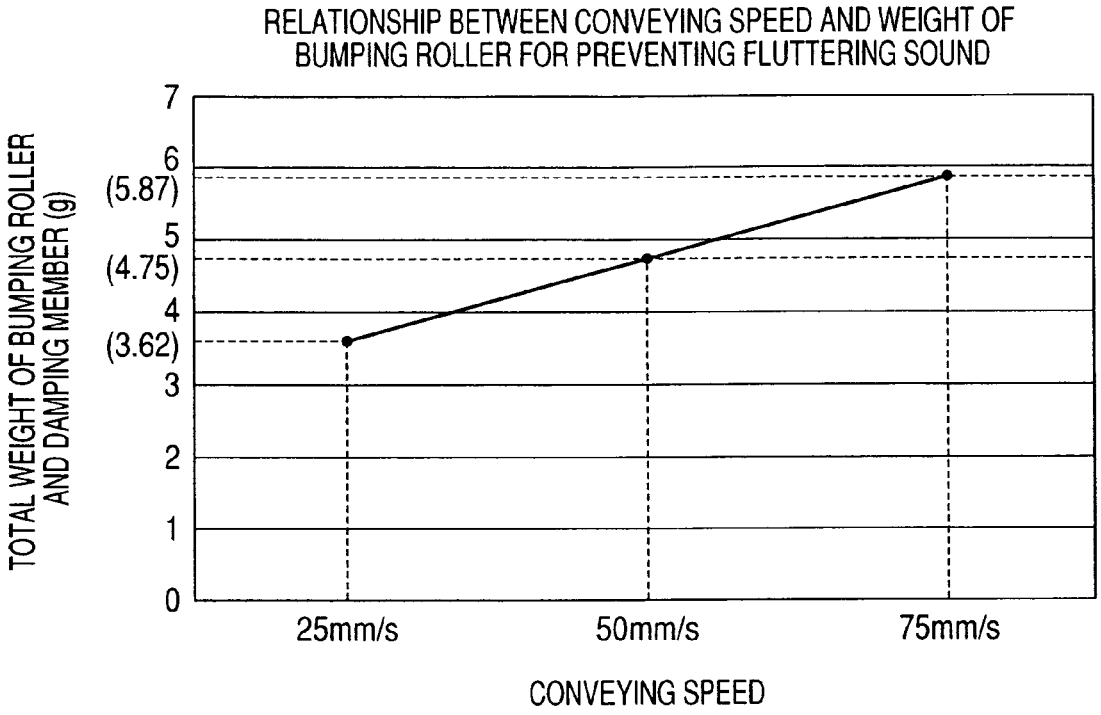
FIG. 8 is an experimentally obtained graph showing a relationship between the sheet conveying speed and the total weight of a roller portion and a damping member required for preventing a pad noise in an apparatus according to a third embodiment.
Figure 9:
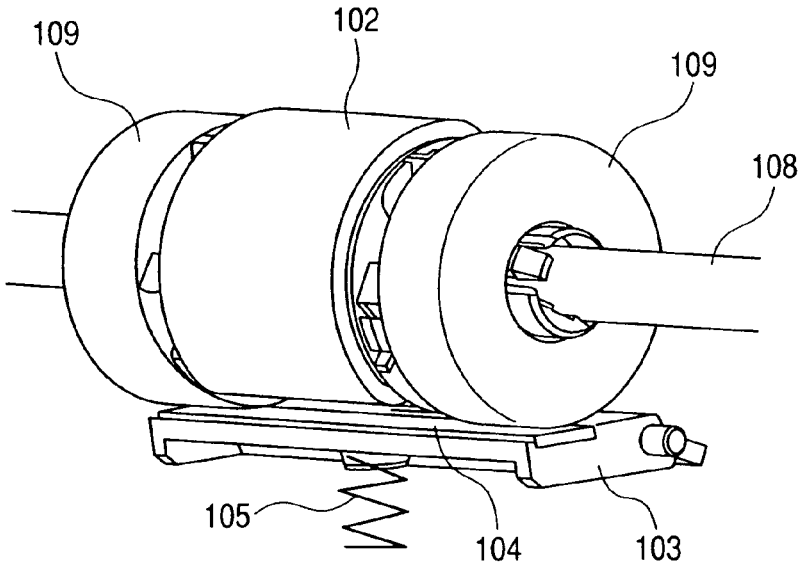
FIG. 9 illustrates an embodiment in which a roller portion is composed of a solid cylindrical roller.

FIG. 8 is a graph obtained experimentally that shows the total weight of the roller portion 109 on which the damping member 201 is attached required for preventing the pad noise in relation to the conveying speed in the sheet feeding apparatus according to this embodiment. As will be seen from this graph, to prevent generation of an unusual noise it is necessary to make the total weight of the roller portion 109 larger in the case where the sheet conveying speed is high than in the case where the sheet conveying speed is low.

From the above result follows the following condition for setting the total weight of the roller portion 109 on which the damping member 201 for suppressing vibration of the roller portion is attached to prevent an unusual noise from occurring:

$$Y \geqq 4.5\times10^{-2}X+2.5$$

where, X (mm/s) is the sheet conveying speed and Y (g) is the weight of the roller portion on which the damping member 201 is attached.

In some sheet feeding apparatuses, the elastic force of the spring 105 may be increased in order to enhance sheet separating performance. In that case, the frequency of the vibration of the sheet caused by stick-slip will become higher. Such vibration can be suppressed by increasing the weight of the roller portion 109 to shift the resonance point.

Such a countermeasure may be realized by constructing the roller portion 109 made of a POM material used in the above-described first embodiment as a solid cylindrical roller, making its basic wall thickness larger, making the width of the roller portion 109 broader, or making the diameter of the roller portion 109 larger to increase the weight of the roller portion 109.

Alternatively, by making the roller portion 109 of a metal material or a resin material having a high relative density such as a POM material so that the weight Y (g) of the roller portion 109 satisfies the condition $Y \geqq 4.5\times10^{-2}X+2.5$, it is possible to prevent continuous vibration like stick-slip from occurring and to prevent generation of an unusual noise.

This application claims priority from Japanese Patent Application No. 2004-218742 filed Jul. 27, 2004, which is hereby incorporated by reference herein.

What is claimed is:

1. A sheet feeding apparatus comprising:

a feed roller having a cut-away portion on its outer circumference, the outer circumference of the feed roller being in frictional contact with a top surface of a sheet stack to apply a feeding force on a sheet;

a pad member that is in pressure contact with said feed roller and that separates sheets between itself and the feed roller;

a roller portion having a shape smaller than the outer diameter of said feed roller and protruding outwardly beyond said cut-away portion, said roller portion coming in contact with said pad member or the sheet to be fed when said cut-away portion of the feed roller is opposed to said pad member; and vibration suppression means having a damping property for suppressing a vibration of the roller portion that may occur by a vibration of the sheet during sheet feeding, said vibration suppression means fixed on a side surface of said roller portion without contacting with said pad member.

2. A sheet feeding apparatus according to claim 1, wherein said vibration suppression means comprises a damping member composed of a material having a damping property.

3. A sheet feeding apparatus according to claim 1, wherein said vibration suppression means comprises a metal piece attached on the side surface of said roller portion so as to increase the total weight of said roller portion.

4. A sheet feeding apparatus comprising:

a feed roller having a cut-away portion on its outer circumference, the outer circumference of the feed roller being to be in frictional contact with a top surface of a sheet stack to apply a feeding force on a sheet;

a pad member that is in pressure contact with said feed roller and that separates sheets between itself and the feed roller;

a roller portion that is made of a resin material and has a shape smaller than the outer diameter of said feed roller and protruding outwardly beyond said cut-away portion, said roller portion comes in contact with said pad member or the sheet to be fed when said cut-away portion of the feed roller is opposed to said pad member; and a metal piece attached on a side surface of said roller portion without contacting with the pad member so as to increase the total weight of said roller portion, and a vibration of the roller portion that may occur by a vibration of the sheet during sheet feeding is suppressed by an increase of the total weight of said roller portion, wherein the apparatus is constructed in such a way that the following condition is satisfied:

$$Y \geqq 4.5\times10^{-2}X+2.5$$

where, X (mm/s) is the speed of a sheet fed by said feed roller and Y (g) is the total weight of said roller portion.

5. A sheet feeding apparatus according to claim 4, wherein said total weight is set to such a weight with which vibration is suppressed by fixedly attaching a metal piece on a side surface of said roller portion.

6. A sheet feeding apparatus according to claim 5, wherein said total weight is set by attaching multiple numbers of said metal pieces.

7. An image forming apparatus comprising:

a sheet feeding apparatus according to any one of claims 1 to 3, 4, 5 and 6; and image forming means for forming an image on a sheet fed by said sheet feeding apparatus.

* * * * *